US006199791B1

(12) United States Patent
Conran et al.

(10) Patent No.: US 6,199,791 B1
(45) Date of Patent: Mar. 13, 2001

(54) DISPENSER FOR ROLL MATERIAL STRIP WITHOUT WINDING CORE COMPRISING AN IMPROVED SUPPORTING SPINDLE

(75) Inventors: Sébastian Conran; Joseph Patrick O'Connor, both of London (GB); Jean-Louis Neveu, Colmar (FR); Bernard Louis Dit Picard, Amfreville la Campagne (FR); Yves Malecot, Crossville la Vieille (FR)

(73) Assignee: Fort James, S.a.r.l., Luxembourg (LU)

( * ) Notice: Subject to any disclaimer, the term of this patent is extended or adjusted under 35 U.S.C. 154(b) by 0 days.

(21) Appl. No.: 09/214,707

(22) PCT Filed: Jul. 11, 1997

(86) PCT No.: PCT/FR97/01303

§ 371 Date: Mar. 15, 1999

§ 102(e) Date: Mar. 15, 1999

(87) PCT Pub. No.: WO98/02373

PCT Pub. Date: Jan. 22, 1998

(30) Foreign Application Priority Data

Jul. 12, 1996 (FR) ..... 96 08766

(51) Int. Cl.[7] ..... B65H 19/00

(52) U.S. Cl. ..... 242/560.2; 242/423.1; 242/422.4; 242/599.2; 242/598.2

(58) Field of Search ..... 242/423.1, 422.3, 242/422.4, 560, 560.2, 599.2, 598.2, 599

(56) References Cited

U.S. PATENT DOCUMENTS

| | | | | |
|---|---|---|---|---|
| 810,606 | * | 1/1906 | Ball | 242/599 X |
| 899,461 | * | 9/1908 | McNeil | 242/422.4 X |
| 1,188,174 | * | 6/1916 | Hillyard | 242/598.2 X |
| 1,778,856 | * | 10/1930 | Hoegger | 242/598.2 X |
| 2,370,821 | * | 3/1945 | Stott | 242/422.4 |
| 2,707,595 | * | 5/1955 | Brown | 242/422.4 |
| 3,126,164 | * | 3/1964 | Perrin | 242/560.2 |
| 3,318,543 | * | 5/1967 | Moore | 242/423.1 X |
| 3,584,802 | * | 6/1971 | Sieber | 242/560.2 |
| 4,878,631 | * | 11/1989 | Tanovici | 242/423.1 |
| 5,484,119 | * | 1/1996 | Olive | 242/422.4 |
| 5,564,645 | * | 10/1996 | Lissoni | 242/423.1 |
| 5,755,397 | * | 5/1998 | Freese | 242/599.1 |
| 5,794,882 | * | 8/1998 | Lewis | 242/423.1 |
| 5,868,342 | * | 2/1999 | Moody et al. | 242/560 |

* cited by examiner

*Primary Examiner*—Donald P. Walsh
*Assistant Examiner*—Collin A. Webb
(74) *Attorney, Agent, or Firm*—Breiner & Breiner

(57) ABSTRACT

The invention proposes a dispenser for a web wound into a coreless roll, the roll (11) being mounted on an irrotational, substantially cylindrical support spindle (14), the web in this dispenser being dispensed by rotationally unwinding the roll (11) around the axis (A1) of the support spindle (14), characterized in that the support spindle (14) includes means (46, 48, 50, 52) axially locking the roll (11) and in that the spindle (14) bears means (36, 50, 52) for decelerating the roll (11) being unwound.

8 Claims, 3 Drawing Sheets

DISPENSER FOR ROLL MATERIAL STRIP WITHOUT WINDING CORE COMPRISING AN IMPROVED SUPPORTING SPINDLE

The invention relates to a dispenser of a wound web in the form of a coreless roll and including an improved spindle.

More specifically, the invention concerns a paper dispenser for public use, in particular, wherein the dispenser assumes the form of a housing and includes at least one roll mounted on a support spindle. The free end of a paper web in a roll passes through a dispensing opening and the user pulling on the free web end unwinds the roll by rotating the roll about the fixed axis of the support spindle.

More particularly, the invention relates to paper dispensers housing coreless rolls, that is rolls of which the center of the wound paper to be dispensed makes direct contact with the support spindle.

Such coreless rolls allow more compact windings and consequently a larger length of paper at a given radial roll bulk.

As a result, the coreless rolls must be operated in special dispensers.

When the user wants to unwind a specific length of paper, he will thereby set the roll in motion. If the traction exerted on the paper is comparatively vigorous, a certain speed of rotation is imparted to the roll about the support spindle and, short of further design features, the kinetic energy stored in the roll may cause excessive unwinding, to the point of self-rotation, beyond the paper length wanted by the user.

Accordingly, the objective of the invention is to propose simple and economic means allowing efficient slowing down of the roll to avert such excessive unwinding, however, the decelerating means must not unduly oppose the deliberate unwinding by the user and must not degrade the paper roll. The opposing force must be less than the force rupturing the pre-cut sheet sizes.

Moreover, it was found necessary to determine with some accuracy and, foremost, to keep the axial roll position in the unwinding position. When the user unwinds the paper, his traction is rarely perfectly perpendicular to the roll's axis of rotation and thereby the roll tends to be axially offset on its support spindle, sometimes so much that it is axially offset from the housing opening through which the paper is meant to pass.

This problem assumes special significance when the dispenser is designed to receive a second roll on the same support spindle, namely in the stored position. When, in such a dispenser, the roll in the unwinding position has been exhausted, no more needs to be done than to axially shift the second roll from the stored position to the unwinding position, such a displacement being possible because the rolls are coreless.

Therefore, another object of the invention proposes means to axially hold the roll in its unwinding position.

For that purpose, the invention proposes a dispenser described above which is characterized in that the support spindle includes means axially locking the roll and in that the spindle bears means assuring roll deceleration during unwinding.

In other features of the invention:

- the roll is axially forced by the braking means against a transverse, axially locking surface,
- the braking means include a flat press bar driven by elastic means against a transverse side of the roll,
- the flat press bar runs radially to the spindle in such a manner that the bar cooperates with the transverse roll side over the full length of a roll radius,

- the flat press bar cooperates with the transverse roll side over the full length of a roll diameter,
- the spindle is irrotational about its axis during roll unwinding and the flat press bar is irrotational relative to the spindle,
- the flat press bar is in the form of a plate elongated in the direction of a roll diameter and is slidable along the support spindle, and the plate includes at each of its ends an axially running guide projection received in an aperture in a stationary guard plate running transversely in the dispenser,
- the guard plate is rigidly affixed to the support spindle,
- a spring is inserted between the guard plate and the decelerating flat bar to axially drive the latter against the roll,
- the spindle is irrotational about its axis when the roll is being unwound and the spindle is fitted with at least one radial boss housed inside the roll and rubbing against the roll to decelerate the roll during unwinding,
- the radial boss runs axially over a length less than the axial roll dimension,
- the radial boss is configured axially substantially at the middle of the roll when the same is in its unwinding position on the support spindle,
- the change in cross-section of the support spindle caused by the radial boss is continuous,
- the radial boss runs around the axis at an angle less than 180°,
- the radial boss is configured at an angle on the support spindle in a direction substantially opposite the direction in which the web is being dispensed,
- the axially locking roll means include a frustoconical boss having the same axis as the support spindle, the base of the boss forming a transverse surface to axially lock the roll in one direction, and the conical surface of the boss facilitating roll installation by axially sliding the roll onto the spindle toward the roll's unwinding position,
- the braking means axially pressing the roll against the base of the frustoconical boss,
- the support spindle includes a T-shaped end to engage a corresponding dispenser channel to detachably affix the spindle in the dispenser and to lock the spindle so as to be irrotational about its axis,
- the T-shaped end of the support spindle is a separate part mounted on the spindle, and
- the means locking the roll axially includes a transverse washer configured between the T-shaped end and the spindle.

Other features and advantages of the invention are elucidated in the comprehensive following description and in relation to the attached drawings:

FIG. 1 shows the case 12 of a paper roll dispenser 10.

The dispenser receives coreless paper rolls 11S, 11D. The dispenser 10 is used, for example, publicly and is able to receive simultaneously two paper rolls, one of them, namely 1lD, being in the unwinding position ready to serve the user and the other, namely 11S, being kept stored and waiting.

Figure 1:
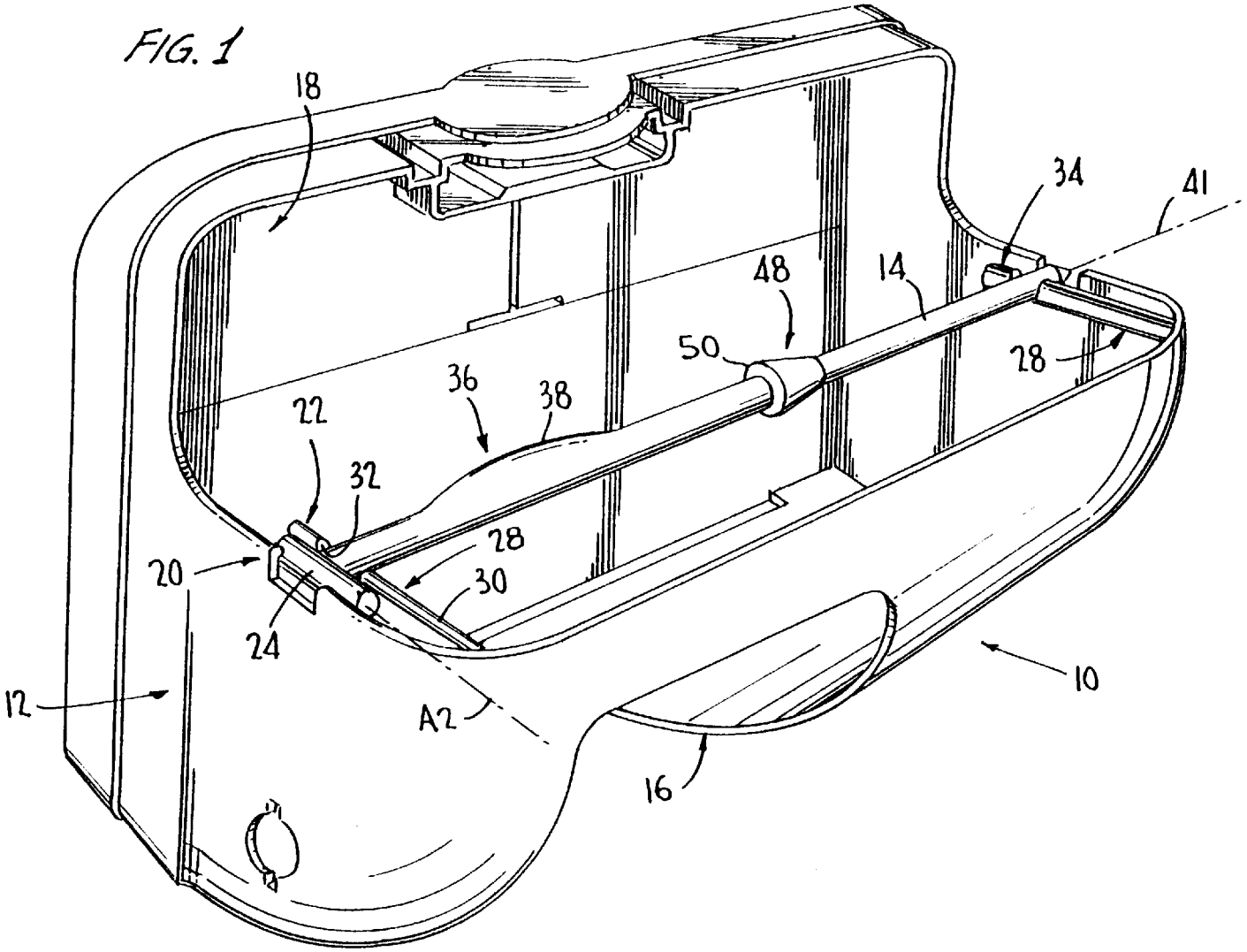
FIG. 1 is a partial perspective of an illustrative first embodiment of the invention.
Figure 2:
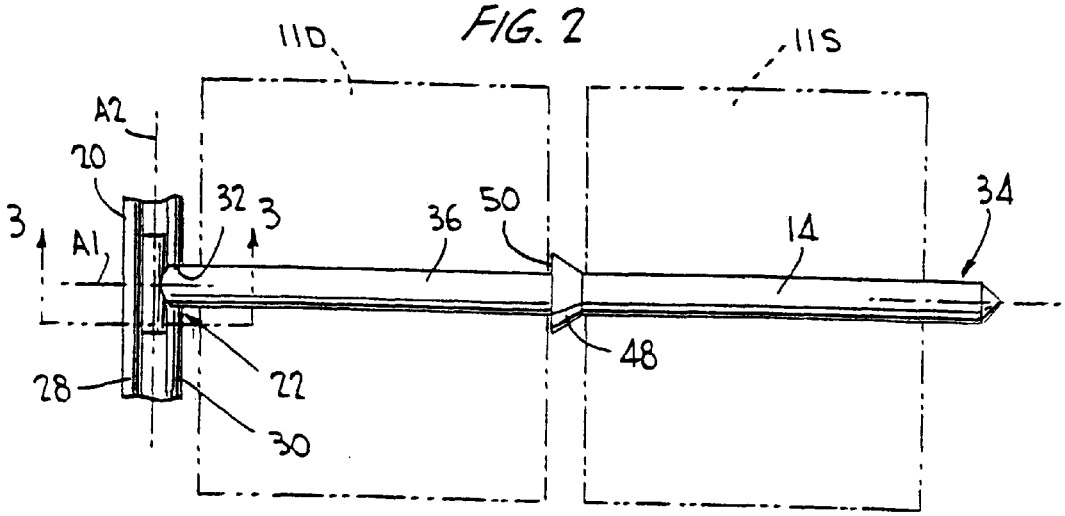
FIG. 2 is a partial top view illustrating the dispenser support spindle of a first embodiment of the invention.

In this state, the two rolls are mounted side by side, inside the case 12 of the dispenser 10, on a substantially straight and cylindrical support spindle having a horizontal axis A1. The roll storage and unwinding positions 11S and 11D, respectively, are shown in broken lines in FIG. 2.

A cover, not shown, serves to close an upper opening in the case 12, through which the rolls 11 are put in place in the dispenser, to form a substantially closed housing.

The dispenser 10 includes a feed slot 16 in the case 12 and allows the free end (not shown) of a roll 11D in the unwinding position to be accessed by a user so he can unwind his desired amount of paper.

In this case, the feed slot 16 is configured at the bottom on the left of the dispenser as seen in the Figures, in such a manner that the right-hand part of the dispenser 10 receives the reserve roll 11S in the stored position.

When the roll in the unwinding position has been exhausted, a mechanism, not shown, allows axial moving of the reserve roll along the support spindle 14 into the unwinding position 11D without the need to open the cover. The shifting of the reserve roll is unhampered by any core of the exhausted roll that would prevent the reserve roll from being moved into the unwinding position.

The support spindle 14 can be detachably mounted in the case 12 of the dispenser 10.

The case 12 includes a plane, vertical rear side 18 to allow mounting of the case, for example, to a building wall. The support spindle 14 is configured essentially at the center of the dispenser 10 and is firmly joined by its two ends to the two vertical side walls 20 of the case 12. The spindle is detachable or not, pivoting or not about one of its ends.

For that purpose, the spindle 14 includes at a first end 22 a cylindrical segment 24 having a transverse, substantially horizontal axis A2 perpendicular to the axis A1 of the spindle 14, so that, in top view, the end 22 of the spindle 14 assumes a T-shape.

On their inside faces 26, the side walls 20 of the dispenser 10 include a channel 28 having a substantially U-shaped cross section in a vertical, longitudinal plane, the U being open upward.

The vertical inner arm 30 of each of the two channels 28 includes a notch 32 having a dimension in the transverse direction substantially equal to the diameter of the support spindle 14.

The transverse cylindrical segment 24 of the T-shaped end 22 of the spindle 14 therefore can be elastically nested, from top toward bottom, as viewed in the Figures, into either of the channels 28, the spindle 14 then being received in a corresponding notch 32.

The opposite end 34 of the support spindle 14 lacks a transverse segment. It is, however, received across the notch 32 of the opposite channel and is maintained therein merely by its own weight plus that of the roll(s) when mounted on the spindle 14.

Such affixation mode of the spindle 14 is especially advantageous because it allows on one hand maintaining the spindle in place in a simple and effective manner and on the other hand preventing the spindle 14 from pivoting about itself around its axis A1. Furthermore, by selecting a cylindrical transverse segment 24 and a correspondingly shaped channel 28, the spindle 14 can hinge about the axis A2 of the transverse segment 24 relative to the dispenser case 12.

In this manner, when the spindle 14 is mounted in the dispenser 10, the paper rolls can be mounted on the spindle 14 by pivoting the spindle about its T-shaped end 22 to insert the rolls by the opposite ends 34 without being required to fully disassemble the spindle 14.

In any case, assembly and disassembly, also full replacement of the spindle 14, are very simply carried out, for example by inserting and removing the transverse segment 24.

A first embodiment of the invention, the illustrative embodiment shown in FIGS. 1 through 4, includes a spindle 14 fitted with a radial boss 36 which allows deceleration of the paper roll being unwound.

The radial boss 36 runs over a limited axial length which is less than the dimension of the paper roll in that direction, and is configured substantially at the middle of the roll when this roll is in the unwinding position 11D on the spindle 14.

The embodiment shown in the Figures does not provide a boss in the spindle 14 that would correspond to the roll's stored position.

The central configuration of the boss 36 biases the roll being unwound towards centering of the roll, thereby averting excessive shift of the roll in the axial direction of the spindle 14. This design, therefore, assures controlled deceleration in the central position. The roll will not rub along its lateral portions. In this manner, the roll stays opposite the dispensing slot 16.

In the illustrative embodiment shown in FIGS. 1 through 4, the radial boss 36 is asymmetric to the axis A1. It runs only at an angle less than 180° around the axis A1 and points upward so that, when seen in transverse section, the spindle 14 is substantially oblong, namely elongated upward relative to the axis A1.

Figure 3:
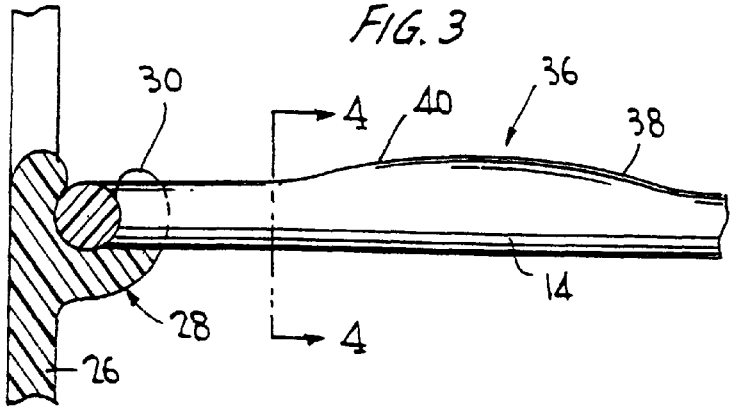
FIG. 3 is a partial view in section along line 3—3 of FIG. 2.
Figure 4:
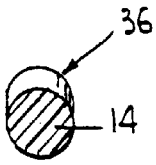
FIG. 4 is a cross-section of the support spindle along line 4—4 of FIG. 3.

The radial boss 36 when seen in horizontal profile, as in FIG. 3, is a convex surface 38 symmetrically merging on either side of the axial direction into the cylindrical surface of the spindle 14 by means of concave surfaces 40. In this manner, the change in cross-section of the spindle 14 at the boss 36 is progressive and continuous.

In the illustrative embodiment shown in FIGS. 1 through 4, the radial boss 36 points upward, on one hand taking into account the weight of the rolls, namely from top to bottom, and on the other hand because the slot 16 allows the user to unwind the paper roll by pulling on the paper substantially vertically downward in the opposite direction of the radial boss 36.

The combination of these two actions causes sufficient friction between the roller and the radial boss 36 to achieve frictional roll deceleration.

The radial boss 36, lacking any angular surface, will not degrade the paper roll.

In a second feature of the invention, the dispenser 10 is fitted with means to lock the roll axially when in its unwinding position.

For that purpose, the spindle 14 includes a frustoconical boss 48 located substantially centrally at the spindle 14 between the storage and unwinding roll positions.

The base 50 of the frustoconical boss 48 subtends a transverse shoulder surface 50 preventing the roll from returning from its unwinding position to its storage position and thereby constraining the roll to remain opposite the dispensing slot 16.

On the other hand, the conical surface of the boss 48 allows the roll to easily pass from its storage position into its unwinding position.

To prevent the roll from moving in the other direction, the roll may simply come to a stop against the channel 28 as in the embodiment shown in FIGS. 1 through 4.

In the first embodiment of the spindle 14, shown in FIGS. 1 through 4, this spindle is unitary.

Figure 5:
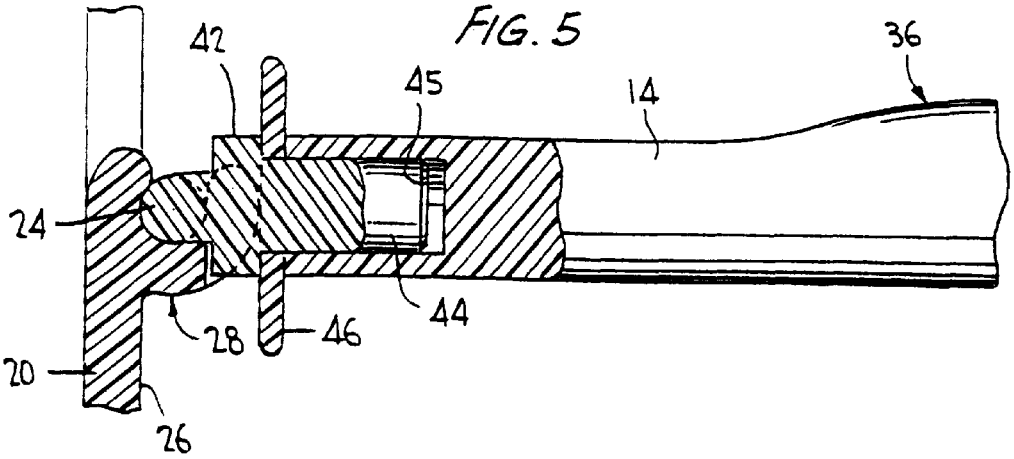
FIG. 5 is a partial axial section illustrating a second embodiment of the invention.

On the other hand, as regards the embodiment shown in FIG. 5, the T-shaped end 22 of the spindle 14 is an assembled part 42.

The assembled T-shaped end 42 includes a stub 44 of axis A1 inserted into a corresponding orifice 45 of the end of the spindle 14. The stub 44 can be affixed to the orifice 45 by any suitable means, such as mechanical threading, bonding or force-fitting.

This second embodiment mode furthermore includes means to assure improved lateral guidance, in the axial direction of the spindle 14, of the roll in the unwinding position.

For that purpose, a transverse washer 46 is mounted on the stub 44 of the assembled end 42 to fix in place the roll in a first direction, in particular to prevent the roll from rubbing against the side wall 20 of the case 12 and against the channel 28.

Figure 6:
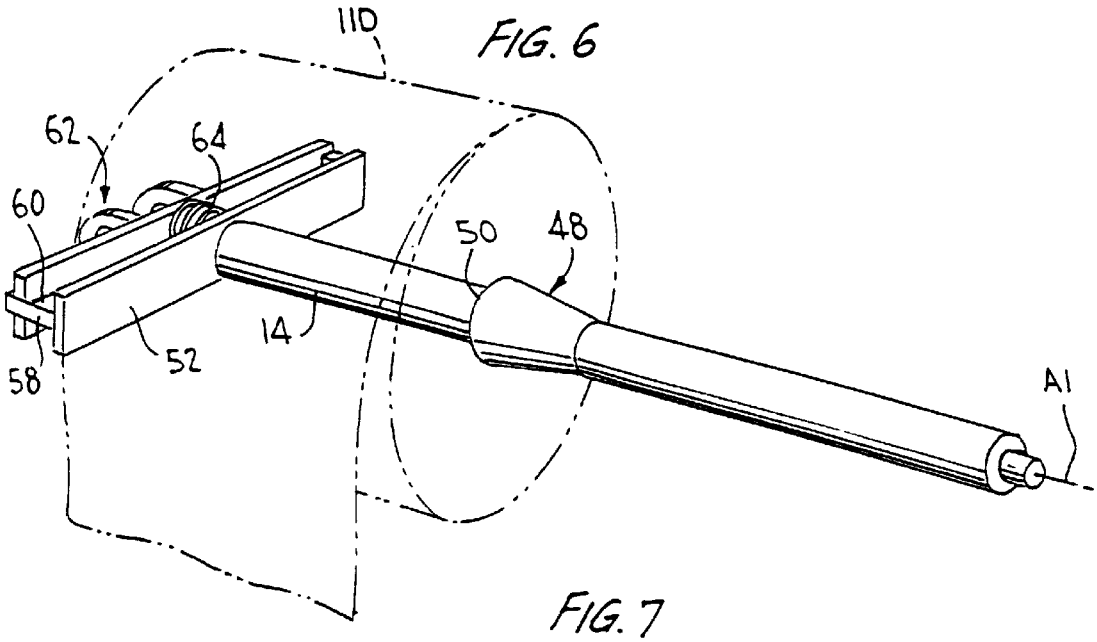
FIGS. 6, 7 and 8 are, respectively, perspective axial-sectional and side views of a support spindle of a third embodiment of the invention.
Figure 7:
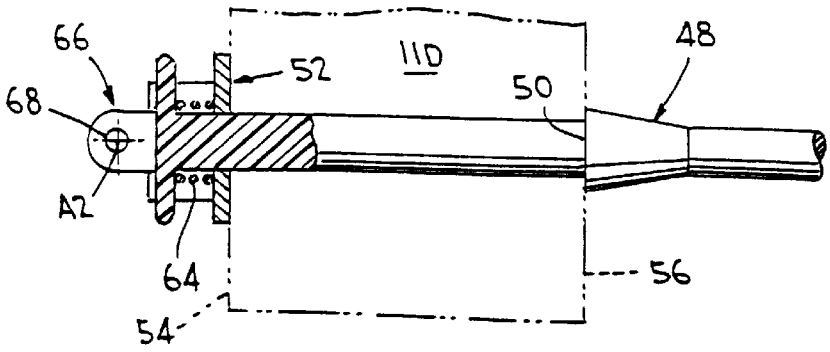
Figure 8:
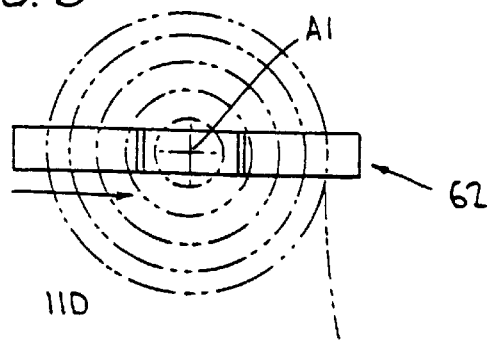

FIGS. 6 through 8 show a third illustrative embodiment of a dispenser of the invention including improved roll deceleration means. Components which are identical with or similar to those already discussed above are denoted by the same reference numbers.

As in the previous two embodiments, the present support spindle 14 includes a frustoconical boss 48 located substantially at the center of the spindle 14 to prevent a roll from moving in a first axial direction, that is from its unwinding to its storage position.

However, this third embodiment of the invention is distinct from the others in that the roll deceleration means are simultaneously used to lock the roll with respect to the opposite direction.

In this design, the dispenser 10 includes a decelerating flat bar 52 slidably mounted on the support spindle 14 on the side of the transverse roll face 54 opposite the transverse face 56 by means of which the roll 11D cooperates with the base 50 of the frustoconical boss 48. The decelerating flat bar 52 is axially forced to come to rest against the corresponding roll face 54 and is irrotational about the axis A1.

Accordingly, by rubbing against the face 54, the flat bar 52 assures deceleration of the roll and simultaneously forces the roll against the base 50 of the frustoconical boss 48, thereby allowing very reliable determination of the roll's position in the dispenser 10.

In the shown embodiment, the flat bar 52 is a plate located in a transverse plane and radially elongated corresponding to a roll diameter of small width.

The flat bar 52 slides axially on the spindle 14 and is kept in fixed position relative to the case 12 of the dispenser 10 by two projections 58 each running axially from the radial ends of the flat bar 52 in the direction parallel to the roll. Each projection 58 is received in an axially sliding manner in a corresponding aperture 60 in a guard plate 62 stationary in the dispenser 10.

The guard plate 62 shown in the Figures is substantially the same shape as the decelerating flat bar 52 and can be made integral with the spindle 14 or in the form of an assembled part in the manner of the washer 46 of the second above described embodiment.

A compression spring 64 is situated between the guard plate 60 and the decelerating flat bar 52 in order to bias the latter to rest against the transverse side face 64 of the roll 11D. The projections 58 include stops preventing the flat bar 52 from excessively deviating from the guard plate 62 when the unwinding position is without a roll.

Obviously other designs can be used to assure irrotationality of the decelerating flat bar. Illustratively, the flat bar 52 can include a fluted socket mounted in sliding manner on a fluted portion of the spindle 14.

The flat bar 52 offers the advantage that its surface in contact with the roll is proportional to the roll diameter. As a result, the decelerating force exerted by the flat bar decreases with roll diameter. The decrease in roll diameter entails a decrease in roll inertia and hence a decrease in the required decelerating force. In this manner, the decelerating force applied by the flat bar 52 on the roll always matches the particular needs.

Lastly, as regards the third embodiment, the support spindle 14 hinges on the case 12 of the dispenser 10 by a clevis-shaped end of which each arm is perforated by an orifice having an axis A2 to pass a hinge rod resting in the dispenser 10.

What is claimed is:

1. A dispenser for a web wound into a coreless roll comprising a substantially cylindrical, irrotational support spindle on which at least one of said coreless roll can be mounted and from one roll of said at least one of said coreless roll the web is dispensed by unwinding the one roll by rotating the one roll about a longitudinal axis of the support spindle, wherein the support spindle comprises means for axially locking the one roll in place on the support spindle, and means for decelerating the one roll when being unwound, wherein the one roll is axially pressed by the means for decelerating against a transverse axially locking surface, wherein the means for decelerating comprise an irrotational, flat press bar axially slidable in the dispenser, wherein the flat press bar is driven by elastic means against a transverse side of the roll, wherein the flat press bar is in the form of a plate elongated in a direction of a roll diameters and wherein the plate comprises at each end an axial guide projection which is received in an aperture in a stationary guard plate extending transversely inside the dispenser.

2. Dispenser as claimed in claim 1 wherein the flat press bar extends radially from the support spindle in such a manner as to cooperate with the transverse roll side over a full length of a roll radius.

3. Dispenser as claimed in claim 2 wherein the flat press bar cooperates with the transverse roll side over the full length of a roll diameter.

4. Dispenser as claimed in claim 1 wherein the flat press bar is irrotational relative to the spindle.

5. Dispenser as claimed in claim 1 wherein the guard plate is rigidly affixed to the support spindle.

6. Dispenser as claimed in claim 5 wherein at least one spring is inserted between the guard plate and the flat press bar to drive said flat press bar axially against the roll.

7. Dispenser as claimed in claim 1 wherein at least one spring is inserted between the guard plate and the flat press bar to drive said flat press bar axially against the roll.

8. A dispenser for a web wound into a coreless roll comprising a substantially cylindrical, irrotational support spindle on which at least one of said coreless roll can be mounted and from one roll of said at least one of said coreless roll the web is dispensed by unwinding the one roll by rotating the one roll about a longitudinal axis of the support spindle, wherein the support spindle comprises means for axially locking the one roll in place on the support spindle, and means for decelerating the one roll when being unwound, wherein the means for axially locking the one roll comprise a frustoconical boss having an axis same as the support spindle, having a base providing a transverse surface which axially locks the one roll in one axial direction, and having a conical surface which facilitates shifting a roll in a stored position on the support spindle by axially sliding on the spindle the roll in a stored position into an unwinding position, and wherein the means for decelerating axially presses the one roll against the base of the frustoconical boss.

* * * * *

UNITED STATES PATENT AND TRADEMARK OFFICE

CERTIFICATE OF CORRECTION

PATENT NO. : 6,199,791 B1
DATED : March 13, 2001
INVENTOR(S) : Sébastian Conran et al.

It is certified that error appears in the above-identified patent and that said Letters Patent is hereby corrected as shown below:

Title page,
The last line of Item [75], "Crossville la Vieille" should read -- Crosville La Vieille --.

Column 6,
Line 40, "diameters" should read -- diameter --.

Signed and Sealed this

Eighth Day of January, 2002

*Attest:*

*Attesting Officer*

JAMES E. ROGAN
*Director of the United States Patent and Trademark Office*